US008668185B2

(12) United States Patent
Leemans et al.

(10) Patent No.: US 8,668,185 B2
(45) Date of Patent: Mar. 11, 2014

(54) SECURITY HOIST

(76) Inventors: Hugo Leemans, Affigem (BE); Guy De Middelaer, Steendorp (BE)

( * ) Notice: Subject to any disclaimer, the term of this patent is extended or adjusted under 35 U.S.C. 154(b) by 0 days.

(21) Appl. No.: 13/384,066

(22) PCT Filed: Jul. 8, 2010

(86) PCT No.: PCT/EP2010/059773

§ 371 (c)(1),
(2), (4) Date: Mar. 26, 2012

(87) PCT Pub. No.: WO2011/006817

PCT Pub. Date: Jan. 20, 2011

(65) Prior Publication Data

US 2012/0181493 A1 Jul. 19, 2012

Related U.S. Application Data

(60) Provisional application No. 61/226,436, filed on Jul. 17, 2009.

(30) Foreign Application Priority Data

Jul. 17, 2009 (EP) ..... 09165814

(51) Int. Cl.
*B66D 1/30* (2006.01)

(52) U.S. Cl.
USPC ..... 254/371; 254/333

(58) Field of Classification Search
USPC ..... 254/264, 266, 333, 371, 373, 374
See application file for complete search history.

(56) References Cited

U.S. PATENT DOCUMENTS

| | | | | | |
|---|---|---|---|---|---|
| 4,420,149 | A * | 12/1983 | Schultes et al. | ..... | 271/9.09 |
| 4,551,785 | A * | 11/1985 | Kroner | ..... | 361/284 |
| 4,662,609 | A * | 5/1987 | Swenson | ..... | 254/371 |
| 2009/0110565 | A1 * | 4/2009 | Parrett et al. | ..... | 417/203 |

* cited by examiner

*Primary Examiner* — Emmanuel M Marcelo
*Assistant Examiner* — Angela Caligiuri
(74) *Attorney, Agent, or Firm* — Gerald T. Gray; Leydig, Voit & Mayer LLP

(57) ABSTRACT

A hoist or capstan fitted with a driving pulley. The latter comprises a peripheral groove for taking a cable and two substantially parallel pulley halves, each pulley halve comprising a flank forming the lateral side of the peripheral groove and being axially pulled toward each other so as to prevent the slipping of a cable by elastic means formed of a continuous polymer ring.

13 Claims, 10 Drawing Sheets

SECURITY HOIST

FIELD OF THE INVENTION

The invention relates to security hoists or capstans, and particularly for such devices for hoisting cradles for maintenance or cleaning teams along high buildings, skyscrapers or windmills.

BACKGROUND OF THE INVENTION

Security problems are of uttermost importance when men have to work with confidence between the earth and the sky. In particular, when they work with cradles, gondolas or even safety harnesses, the hoists or capstans acting on the suspension cables or ropes from which they hang have to ensure a totally fool-proof holding.

DESCRIPTION OF PRIOR ART

Such hoists or capstans are known from several documents, such as e.g. EP-0 301 657, EP-0 172 975 or U.S. Pat. No. 4,074,582. They generally describe hoists comprising a driving pulley consisting of two parallel pulley halves which are pressed against each other so as to ensure a good gripping on the cable or rope running through them. The problem that arises with ageing of such devices is that the metal springs pressing the pulley halves together are bound to be calibrated or even replaced frequently, and that the pressure exerted on the cable is never equally distributed.

U.S. Pat. No. 4,662,609 describes a kind of pulley adaptable on a ship's existing capstan. This pulley is fastened to the capstan by bolts. A cushion (for example an old tire) ensures that the pulley remains flat. This pulley does not exert any holding back force on a cable.

US-2008/0083912 describes a break-away cable sheave for a tire carrier which has nothing in common with the present application.

SUMMARY OF THE INVENTION

A first object of the invention is to develop a hoist exerting a more even pressure on the cables.

Another object of the invention is to space out the maintenance of such hoists without impairing their reliability.

Another object of the invention is to ensure a better gripping effect on the cables or ropes.

Another object of the invention is a hoist able to cope with a vide variety of cables, whatsoever their manufacturer.

The subject of the invention is a hoist comprising a driving pulley comprising a peripheral groove for taking a cable. Said driving pulley comprises two substantially parallel pulley halves, each pulley halve comprising a flank forming a lateral side of the peripheral groove and being axially pulled toward each other so as to prevent the slipping of a cable by a continuous polymer ring having a width which is the difference between a radius of an inner circular face and a radius of an outer circular face, said polymer ring comprising two flat ends extending in planes normal to a ring axis.

This novel design brings about several non-obvious advantages that will be described hereafter.

The polymer is preferably elastomeric polyurethane.

The polymer ring advantageously comprises two flat ends extending in planes normal to the ring axis.

According to a preferred embodiment, it comprises through-holes for the passage of fastening means, as e. g. pins.

The tightening of the polymer ring and hence the constraining force pulling together the two sides of the groove is preferably limited by abutment means.

The ratio between the axial extension of the flat end of the polymer ring and its width is preferably comprised between 2 and 3.

The polymer from which the ring is made has preferably a hysteresis lower than 5%, and most preferably lower than 3%.

The contact surfaces between the polymer ring and fast parts of the driving pulley are advantageously covered by a low friction coating.

SHORT DESCRIPTION OF THE DRAWINGS

These and further aspects of the invention will be explained in greater detail by way of example and with reference to the accompanying drawings wherein.

Figure 5:
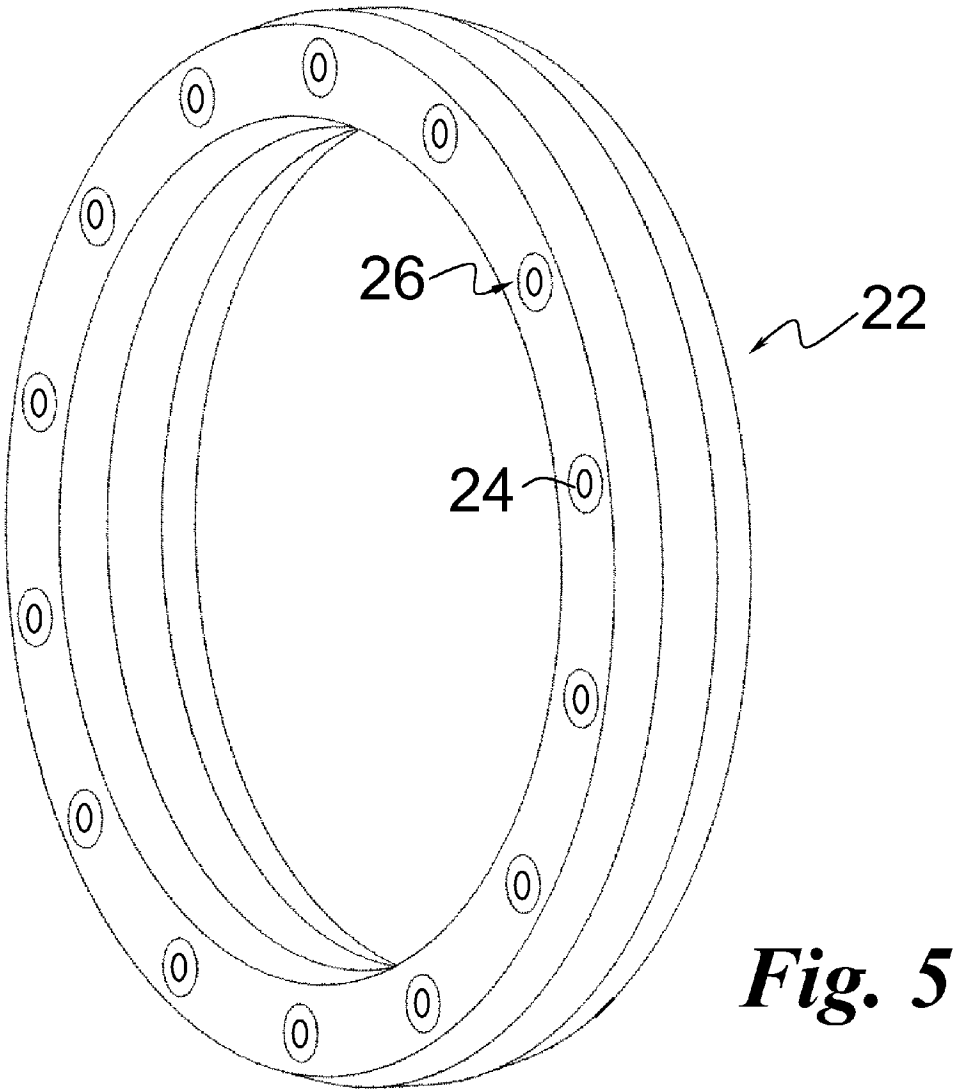
FIG. 5 is a view in perspective of the polymer ring of a hoist of the invention.
Figure 5A:
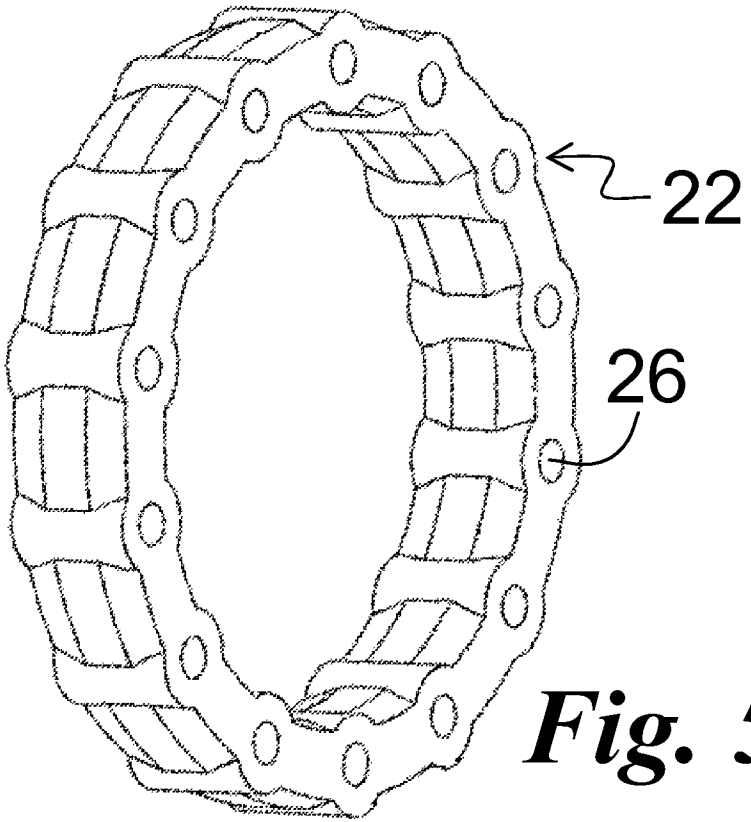
Figure 6:
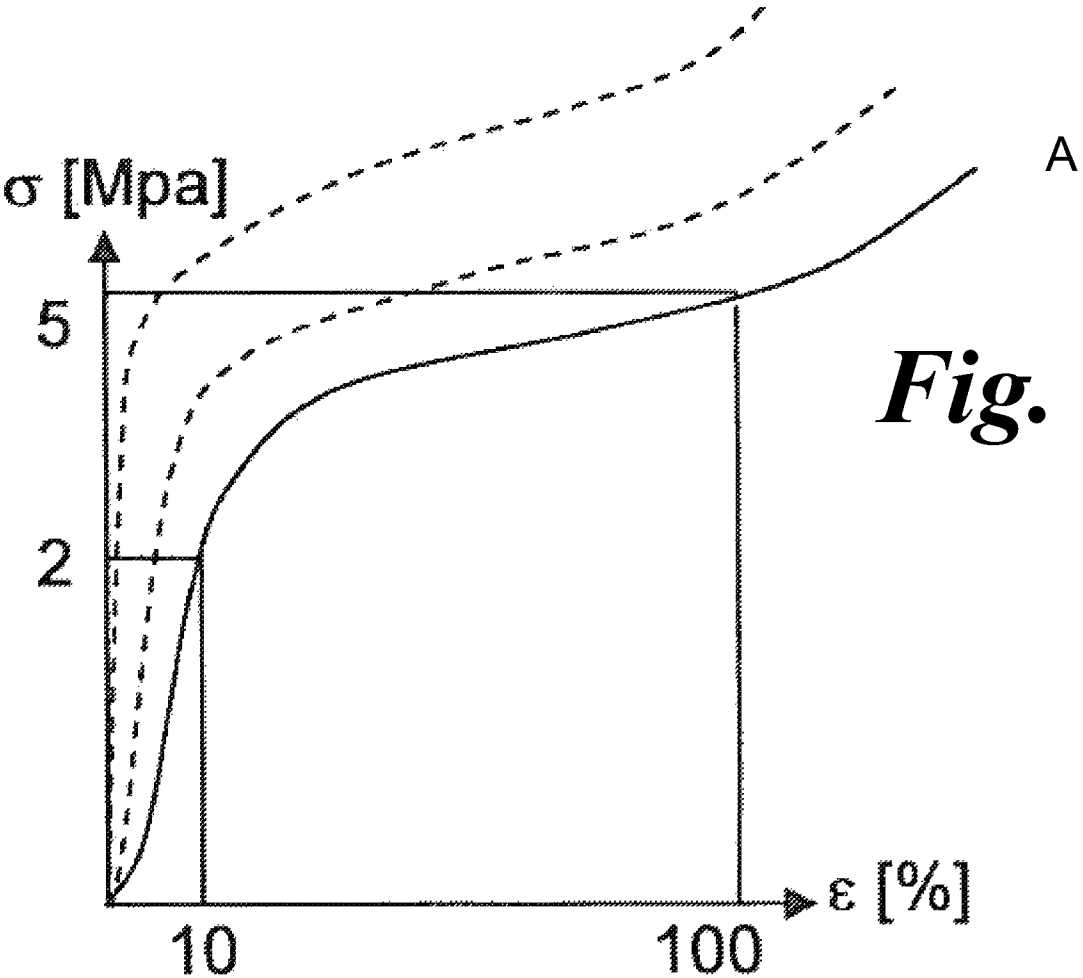
Figure 7:
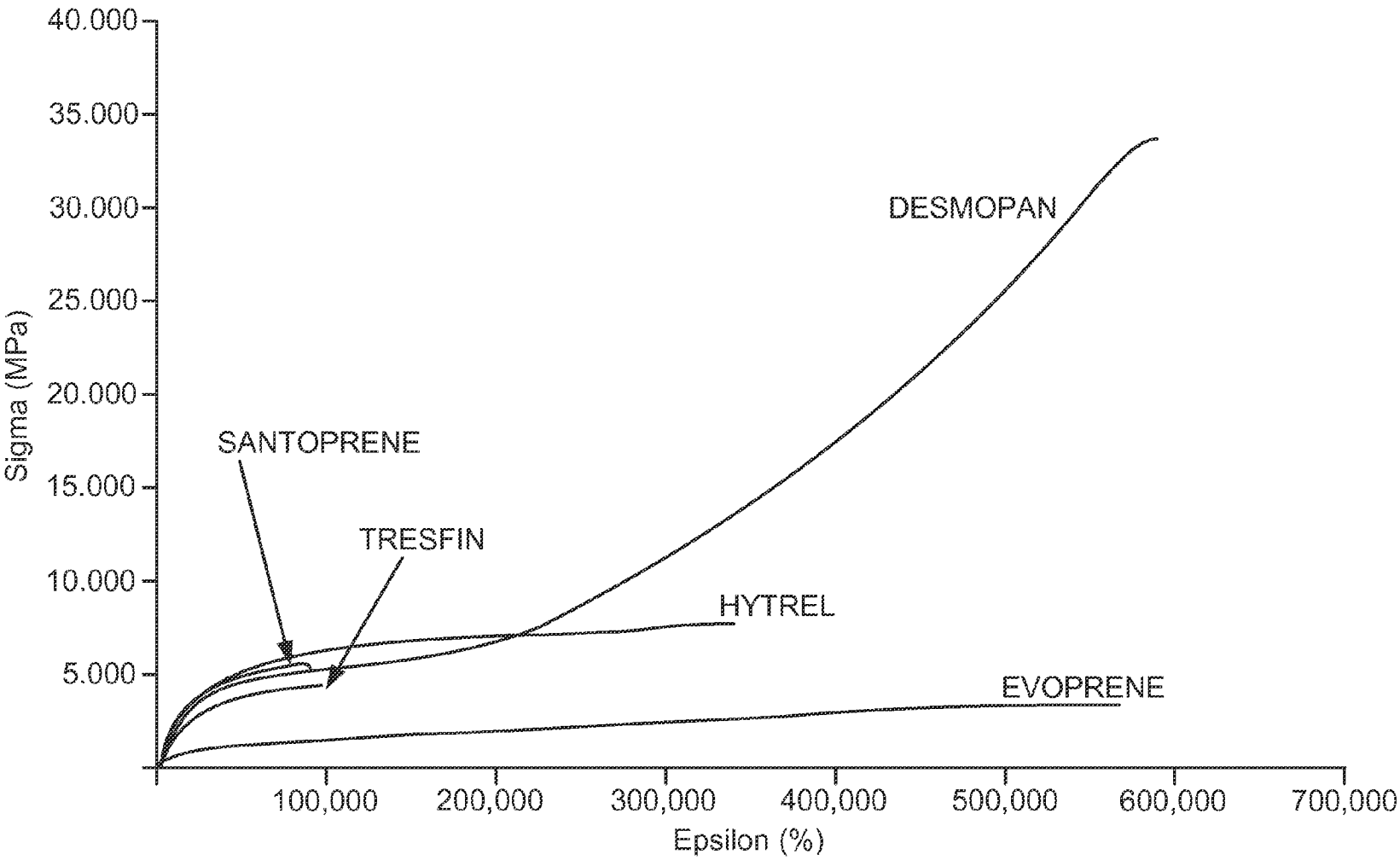
Figure 8:
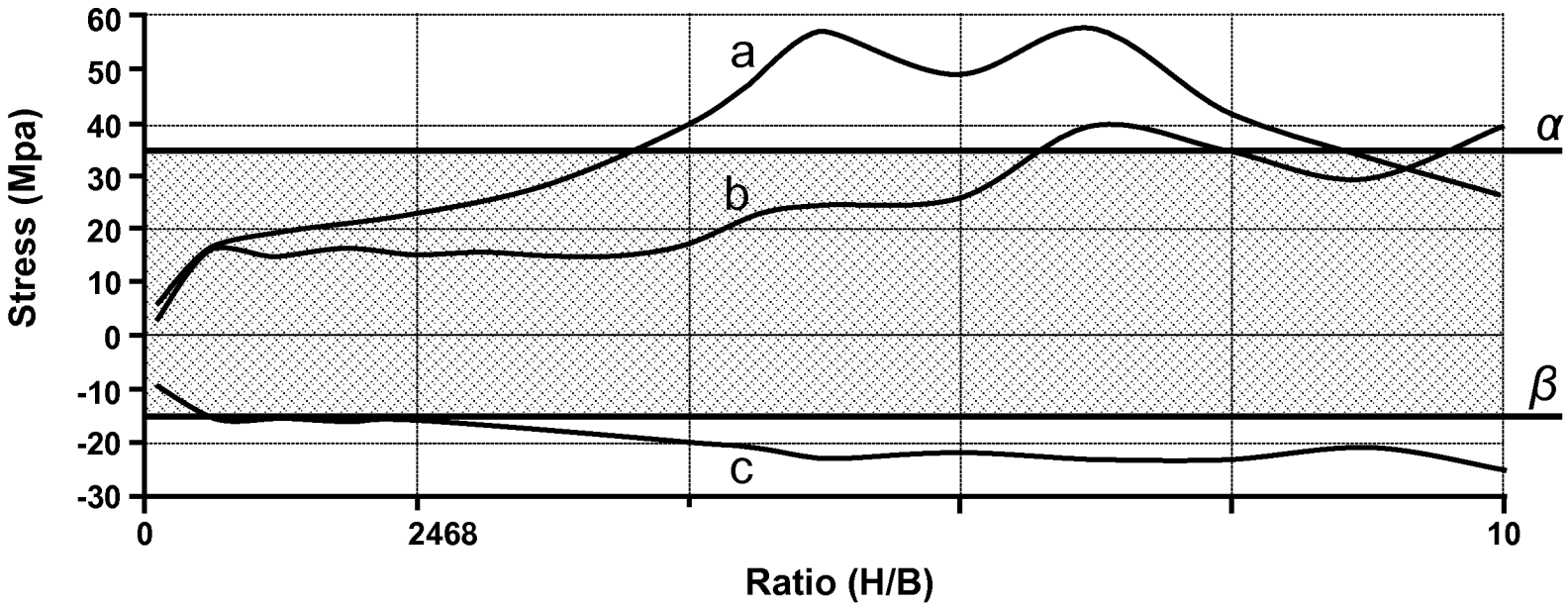
Figure 9:
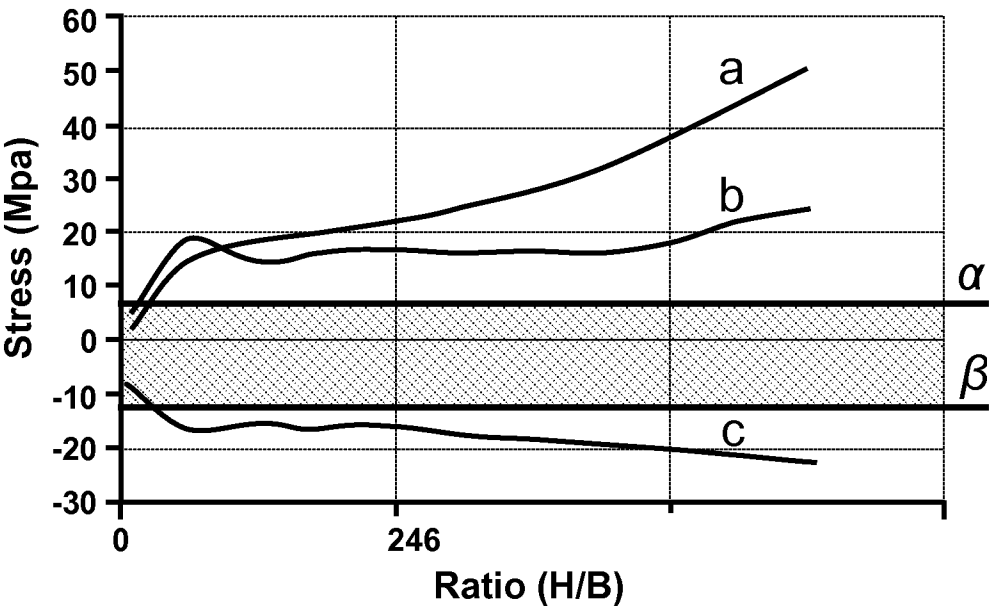

FIG. 5*a* is a view in perspective of another possible embodiment of the polymer ring of a hoist of the invention;

FIG. 6 is a theoretical strain/stress chart of the required elastomer;

FIG. 7 is a chart displaying the curves obtained with different kinds of elastomers;

FIGS. 8 and 9 are test charts displaying exemplary curves stress/length ratio for two different elastomers.

The figures are not drawn to scale. Generally, identical components are denoted by the same reference numerals in the figures.

DETAILED DESCRIPTION OF PREFERRED EMBODIMENTS

Figure 1:
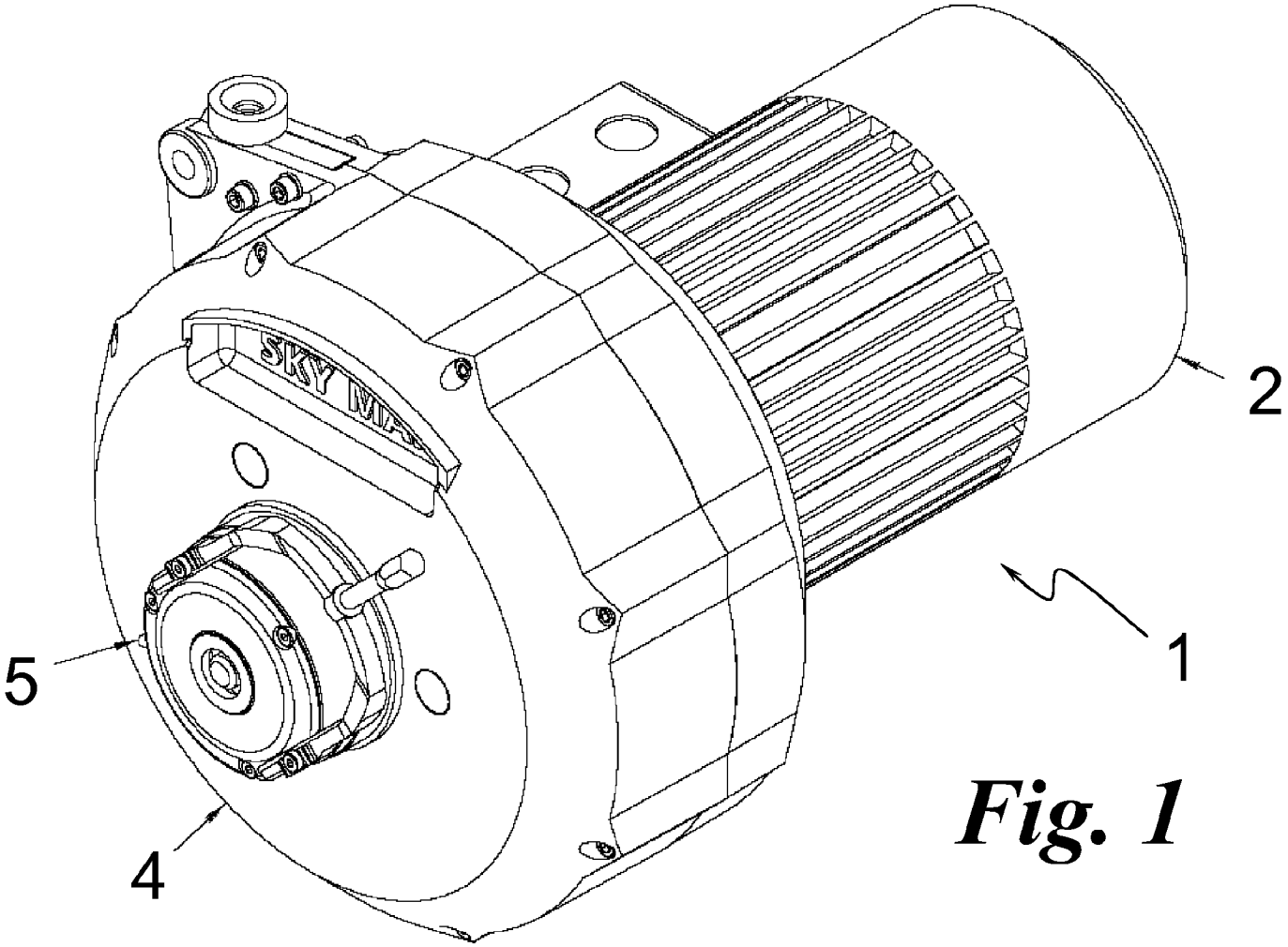
FIG. 1 is a view in perspective of the hoist of the invention affixed to its motor.
Figure 2:
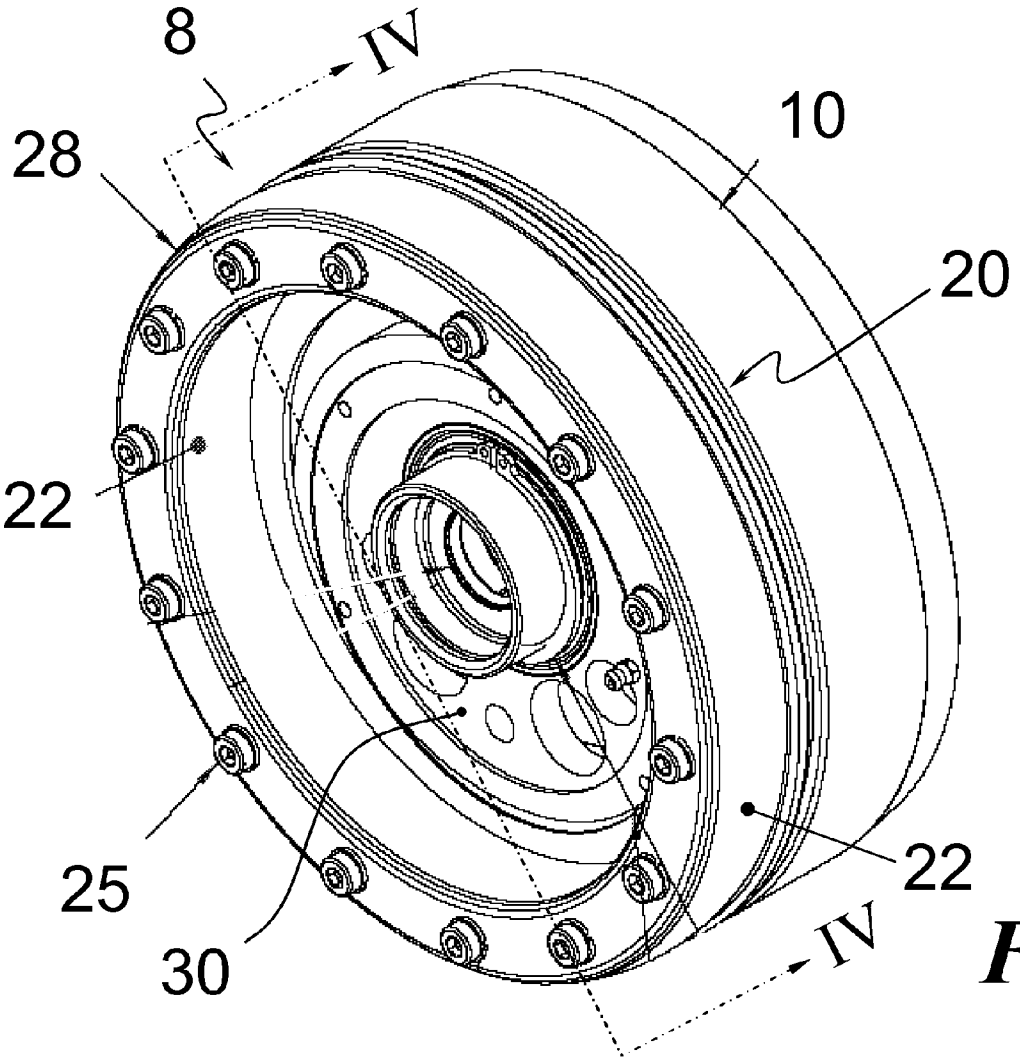
FIG. 2 is a more detailed view in perspective of a part of the hoist (without its driving motor)

An embodiment of the hoist 1 of the invention is depicted in FIG. 1. This hoist 1 comprises a driving motor 2 and a cable driving part 4 with security brake 5 affixed to the driving axis of this motor 2.

Figure 3:
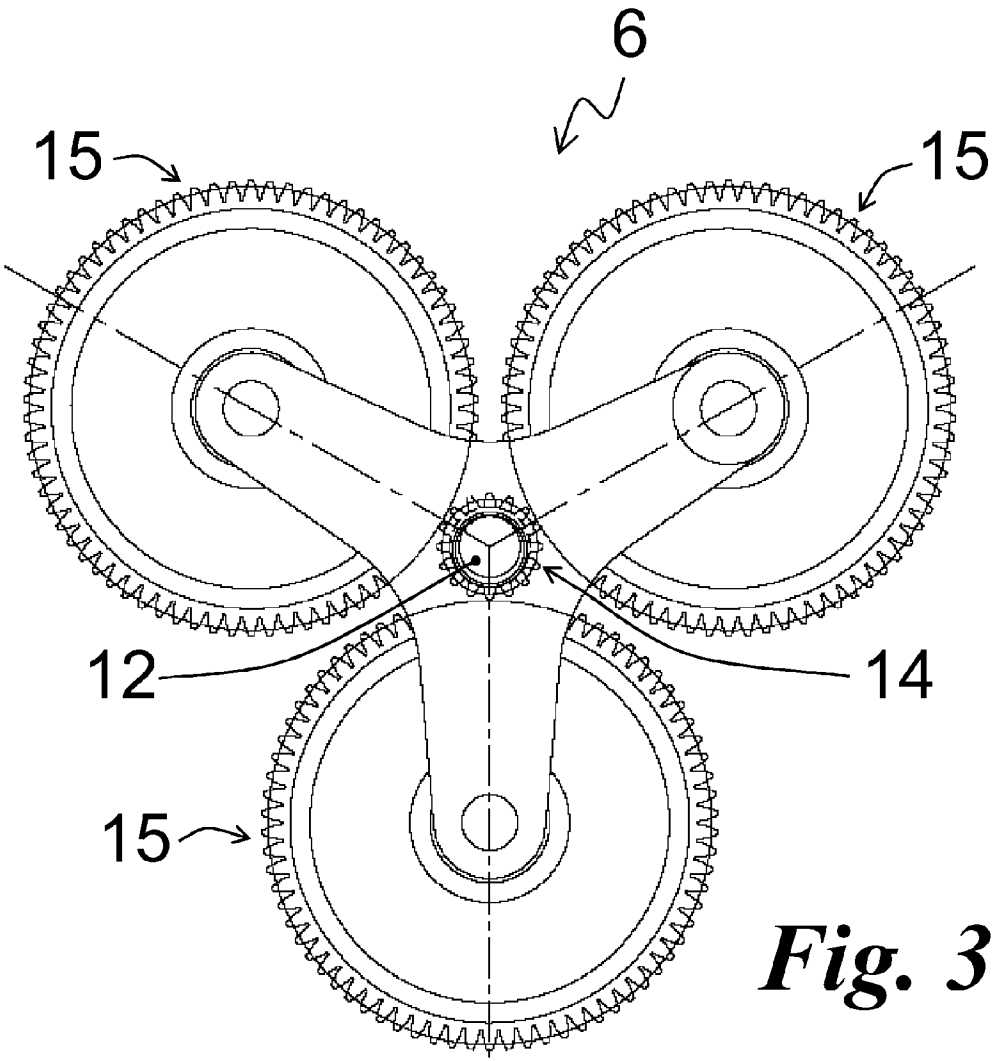
FIG. 3 is a view of the driving part of the hoist of FIG. 2.
Figure 4:
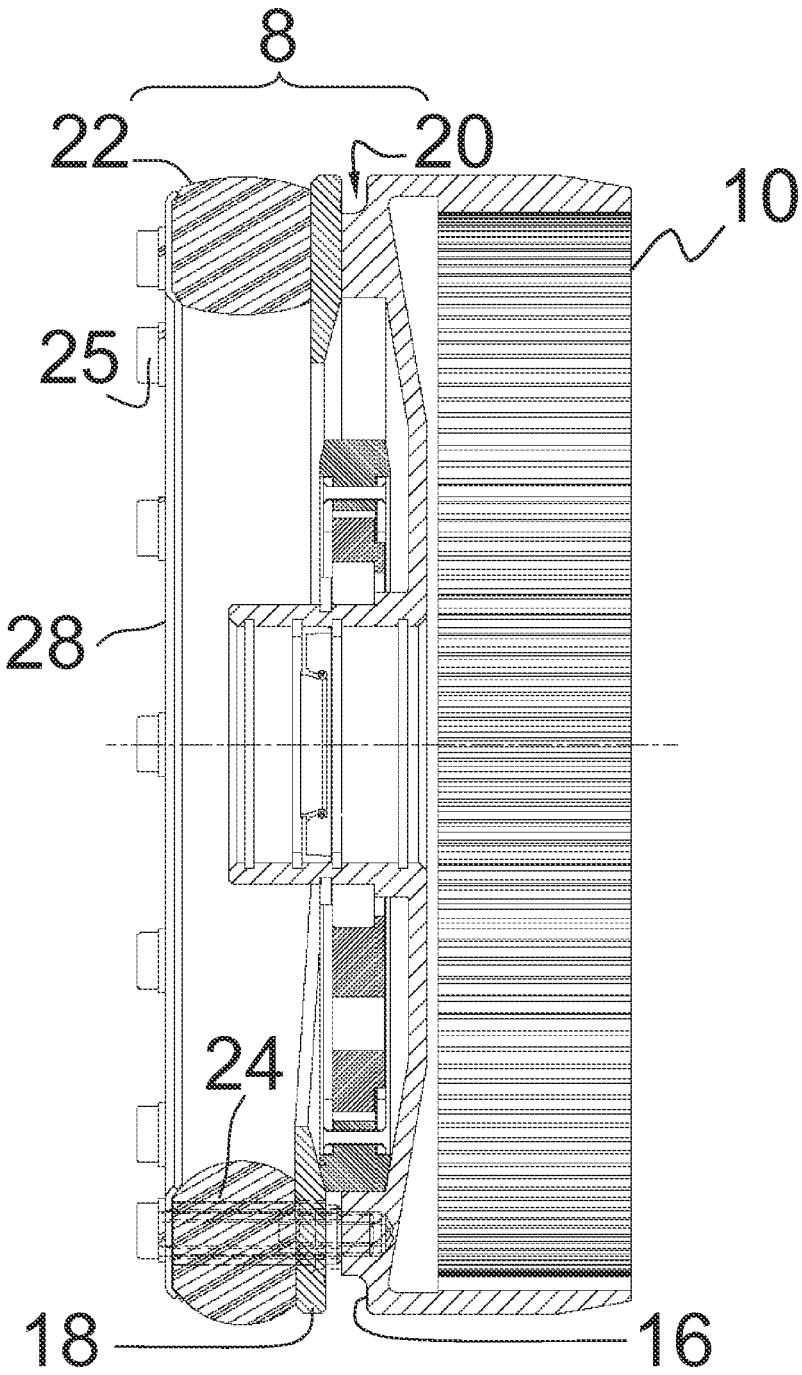
FIG. 4 is a partial view of a section of FIG. 2 cut along plane IV-IV.

The cable driving part 4 comprises two main parts: an inner gearing 6 (see FIG. 3) and an outer, cable holding part 8 (see FIG. 4). To ensure a maximum compactness, the gearbox reducing the motor speed comprises a planetary gearing 6 placed inside a cylindrical gearing 10 with inner teeth, which supports the cable holding part 8. The planetary gearing 6 comprises a central axis 12, connected to a driving axis of the motor 2. This central axis 12 bears a central gearing 14, in direct drive with three planetary gearings 15 borne by a triple arm. The teeth of the three planetary gearings 15 engage the teeth placed at the inner side of the cylindrical gearing 10. The torque of the motor is thus distributed among three distinct teeth, enhancing the security of the hoist. As can be seen in FIG. 4, the back flange of the cylindrical gearing 10 comprises a peripheral rabbet 16. This rabbet 16 is closed at its open end with a mobile flange 18, forming a groove 20 which is designed to accommodate a cable or rope (not shown). The cable is pinched or gripped between the two sides of the groove, allowing it both to be firmly held and to veer out at a given speed, depending upon the rotation of the motor. It is of uttermost importance that this cable be firmly held without being damaged.

The main advantage of the hoist of the present invention is that the mobile flange 18 is pressed against the fast side of the rabbet 16 by a polymer ring 22 instead of a series of metal springs, as in the prior art devices.

A crown-shaped embodiment of this polymer ring 22 is shown in detail in FIG. 5. Another possible embodiment displaying a series of barrel-shaped parts is shown at FIG. 5*a*.

The use of such a polymer ring 22 brings about a series of unexpected advantages.

The main problem when using metal springs is that the force they apply to the mobile flange is never evenly distributed. It is thus compulsory to multiply the number of springs so as to obtain as good a distribution as possible, so that the cable is evenly gripped all along its length caught in the groove, limiting outbreak of local stresses leading to deformations of the cable, known as "bird caging" (the strands nearer to the core of the cable undergoing an elongation lesser than the peripheral strands). Due to their cumbersomeness it is alas impossible to multiply indefinitely the number of springs. Furthermore, at assembly stage (and whenever the hoist is dismantled), each spring has to be carefully set by the use of a dynamometric wrench on the bolts which fasten it.

Finally, each hoist has to cope with a wide variety of cables. According to its origin (country, manufacturer, internal standards of production, and so on), though it is deemed to correspond to a same nominal diameter, each cable exhibits slightly different mechanical characteristics: resistance to wear, elongation, friction coefficient, etc. This means that each hoist has to be adapted to the kind of cable it has to cope with, and even that the combination with some kinds of cables has to be avoided.

This problem simply disappears when using the hoist with polymer ring 22 of the invention: calibrated abutment means (tubing 24) are inserted in a series of through-holes 26 spread evenly along the perimeter of the ring 22, which generally has, as shown at FIG. 5, the form of a crown delimited by two planes normal to the crown's axis. When the ring 22 is put in place, the presence of these abutment means 24 prevents bolts 25 holding a fastening flange 28 from exerting any uneven (local) force on the polymer of the ring. Consequently, an even constraining force is exerted along the whole lateral surface of the mobile flange 18. One can thus say that a cable caught in the groove is submitted on every degree of 360° to an even constrain. This allows the use of the hoist of the invention on a wide variety of cables, and even on lower quality cables, without impairing the security of workers.

The cables being firmly gripped, it still must be introduced on the drum of the hoist and allowed to leave it. This function is ensured by an eccentric 30 which, while the drum is rotating, slightly moves away from each other the lateral sides of the groove 20.

Another advantage of the polymer ring 22 over classical, mechanical spring-loaded hoists is its reduced weight (owing i.a. to the reduction of the number of metal parts).

Another advantage is the ease of maintenance: at the end of its nominal life, the ring is simply disposed of and replaced by a new ring, without special care, as the bolts simply ought to be firmly tightened on the abutment tubing 24.

A further, paradoxical advantage is that resilient means as polymer rings fill up more volume than their metal equivalent. Accordingly, no scraps of metal or other debris can pile up in nooks and crannies, disrupting the good working order of the device (as it is known to happen frequently with "classical", i.e. spring-loaded, hoists).

Of course, a polymer ring cannot rust. This means that the hoist may stay in unaccustomed moisture conditions without loosing its efficiency.

As it will appear below, the flexibility of the polymer ring is better used than with mechanic springs. Stress being evenly parted along the whole circumference of the ring, whatsoever the intrinsic properties of the polymer that is used, a better hysteresis performance is obtained globally.

The main problem was of course to find the kind of polymer which should be used to obtain (a) the required spring properties, (b) the required reliability (length of life) (c) the required resistance to bad weather and temperature conditions, to meet the high quality standards that apply in this branch of technology and industry.

The inventor carried tests on countless varieties of polymers, or more properly elastomers in order to determine the most adequate material.

Stiffness Property

If the material is too flexible, the compatibility with stress and displacement will not be reached.

FIG. 6 displays the theoretical stress-strain curve that has to be respected to ensure a good maintaining of the cable. Curve A determines the lower limit to be respected: at 10%, the compression modulus ($E=\sigma/\epsilon$) must be higher than 20 (straight part of the curve), while at 100% (above the bend of the curve, corresponding to the yield point) the modulus must be higher than 5 Mpa. Any competing material should obtain at least a curve above curve A.

FIG. 7 displays tests results obtained with a series of competing polymers: SANTOPRENE® (a thermoplastic elastomere) from ERIKS, HYTREL® (a PTFE elastomere) from Dupont de Nemours, DESMOPAN® (a Thermoplastic urethane) from Bayer, EVOPRENE® and TYRESFIN® (an elastomere used for the making of tyres). EVOPRENE® is clearly too flexible to ever reach equilibrium and was removed from further tests. It is clear from FIG. 7 that thermoplastic urethane and PTFE elastomere seem the most promising materials, provided that they will pass other tests (as e.g. stability in time and durability).

Stress Factor

A further point that had to be determined was how to reduce the stress in the pressure ring. This can be done by acting on the following factors:

The width of the ring. Tests however proved that the maximum stress was reached in a very narrow portion near the border of the ring, so that, though increasing the width does influence the maximum stress, a very acceptable value is reached as from the moment the H/B ratio exceeds 2 (see FIGS. 8 and 9). In FIGS. 8 and 9, the upper limits for the tested material are noted as α, the lower limits (under compression condition) as β. Curve "a" is the Von Mise measure (compression and tension stress in the corner of the material). Curves "b" and "c" are measured respectively on the material under compression and under tension.

Accordingly, to limit the cumbersomeness of the hoist, the best dimensions of the ring (H/B ratio) should be between 2 and 3, or better between 2 and 2.5, as obtained for urethane (DESMOPAN®) (FIG. 8). The similar curves obtained with PTFE HYTREL®) clearly fall outside the required limits.

The preload of the ring: Preloading the material seemed at first sight to be unavoidable, because this preload is deemed to produce at once a good support of the cables. However, the inventors established that if the material had a sufficiently high stiffness (straight curve) the deflection could be reduced while maintaining the same pressure on the steel wire rope. The inventors thus chose to use a high stiffness material, which allowed reducing the preload distance.

Friction coefficient: the displacement of the polymer i.a. along the abutment tubing was proven to induce a further stress in the material and a rise of the temperature. The friction coefficient had to be lower than 0.07 or between 0.1 and 0.15. This was achieved by projecting a low friction coating on the contact surface, which provokes a considerable decreasing of the maximum stress.

The various tests that were carried out prove that for the time being, the best results were to be expected from thermoplastic urethane, particularly the DESMOPAN® product.

This does not imply that other polymers are to be set aside, but demonstrate that the object of the invention can well be reached with polymers presently on the market. The number of tests that had to be carried out on samples demonstrates the non-obviousness of the choice.

It will be appreciated by persons skilled in the art that the present invention is not limited by what has been particularly shown and described hereinabove. The invention resides in each and every novel characteristic feature and each and every combination of characteristic features. Reference numerals in the claims do not limit their protective scope. Use of the verb "to comprise" and its conjugations does not exclude the presence of elements other than those stated. Use of the article "a" or "an" preceding an element does not exclude the presence of a plurality of such elements.

The present invention has been described in terms of specific embodiments, which are illustrative of the invention and not to be construed as limiting.

The invention claimed is:

1. Hoist comprising a driving pulley comprising a peripheral groove for taking a cable wherein said driving pulley rotates around an axis and comprises two substantially parallel pulley halves, each pulley halve comprising a flank forming a lateral side of the peripheral groove and being axially pressed toward each other by a continuous polymer ring so as to pinch the cable between the two sides of the groove and prevent a slipping of the cable, said polymer ring comprising two flat ends extending in planes normal to the ring axis and having a width (B) which is the difference between a radius of an inner circular face and a radius of an outer circular face.

2. The hoist according to claim 1, wherein the polymer is elastomeric polyurethane.

3. The hoist according to claim 1 wherein the polymer ring comprises through-holes extending parallel to the ring axis for the passage of fastening means.

4. The hoist according to claim 3, wherein the fastening means are bolts or pins.

5. The hoist according to claim 4 wherein the tightening of the polymer ring and hence a constraining force pulling together the two lateral sides of the groove is limited by abutment means.

6. The hoist according to claim 4 wherein the ratio between an axial extension of the polymer ring (H) and the width (B) of the ring is comprised between 2 and 3.

7. The hoist according to claim 6 wherein the polymer from which the ring is made has a hysteresis lower than 3%.

8. The hoist according to claim 1 wherein the tightening of the polymer ring and hence a constraining force pulling together the two lateral sides of the groove is limited by abutment means.

9. The hoist according to claim 1 wherein the ratio between an axial extension of the polymer ring (H) and the width (B) of the ring is comprised between 2 and 3.

10. The hoist according to claim 1 wherein the polymer from which the ring is made has a hysteresis lower than 5%.

11. The hoist according to claim 10 wherein the polymer from which the ring is made has a hysteresis lower than 3%.

12. The hoist according to claim 1 wherein contact surfaces between the polymer ring and fast parts of the driving pulley are covered by a low friction coating.

13. The hoist according to claim 12 wherein the polymer from which the ring is made has a hysteresis lower than 5%.

* * * * *